US005360362A

United States Patent [19]

Cernansky et al.

[11] Patent Number: 5,360,362

[45] Date of Patent: Nov. 1, 1994

[54] FOOTPRINT GENERATING TOY

[75] Inventors: Joseph Cernansky, Lomita; George T. Foster, Signal Hill, both of Calif.; Elliot Rudell, 1619 Gramercy Ave., Torrance, Calif. 90501

[73] Assignee: Elliot A. Rudell, Torrance, Calif.

[21] Appl. No.: 939,068

[22] Filed: Sep. 1, 1992

[51] Int. Cl.[5] ..... A63H 33/28; A63H 7/06; B41F 11/00

[52] U.S. Cl. ..... 446/16; 446/289; 446/193; 101/328

[58] Field of Search ..... 446/16, 289, 290, 452, 446/193; 401/208, 197; 101/328–331

[56] References Cited

U.S. PATENT DOCUMENTS

| | | | |
|---|---|---|---|
| 306,464 | 10/1884 | Block | 446/452 |
| 491,331 | 2/1893 | Blair | 401/197 |
| 673,960 | 5/1901 | Looker | 401/197 |
| 2,753,641 | 7/1956 | Dorman | 101/328 |
| 2,996,836 | 8/1961 | Tieri | 446/289 |
| 3,228,136 | 1/1966 | Rouse | 446/16 |
| 4,016,673 | 4/1977 | Constance | 446/18 |
| 4,576,582 | 3/1986 | Panzarella | 446/16 |

FOREIGN PATENT DOCUMENTS

| | | | |
|---|---|---|---|
| 490810 | 8/1938 | United Kingdom | 446/290 |

*Primary Examiner*—Mickey Yu

*Attorney, Agent, or Firm*—Blakley, Sokoloff, Taylor & Zafman

[57] ABSTRACT

A toy device that leaves a liquid footprint as the device is moved along a surface. The device includes a housing that resembles a duck. Attached to the bottom of the duck is a roller that can rotate relative to the housing, so that the toy can be pushed or pulled along a sidewalk or other similar surface. The housing is connected to a handle that allows the user, such as a small child, to move the toy along the surface. Attached to the roller are a pair of sponge pads that are constructed to resemble the feet of a duck. The sponge pads are soaked with water and leave a liquid pattern when pressed into contact with a surface. The sponge pads are located on the roller, such that a duck foot shaped pattern is left on the surface each time the user moves the duck and rotates the roller.

13 Claims, 4 Drawing Sheets

FIG. 1
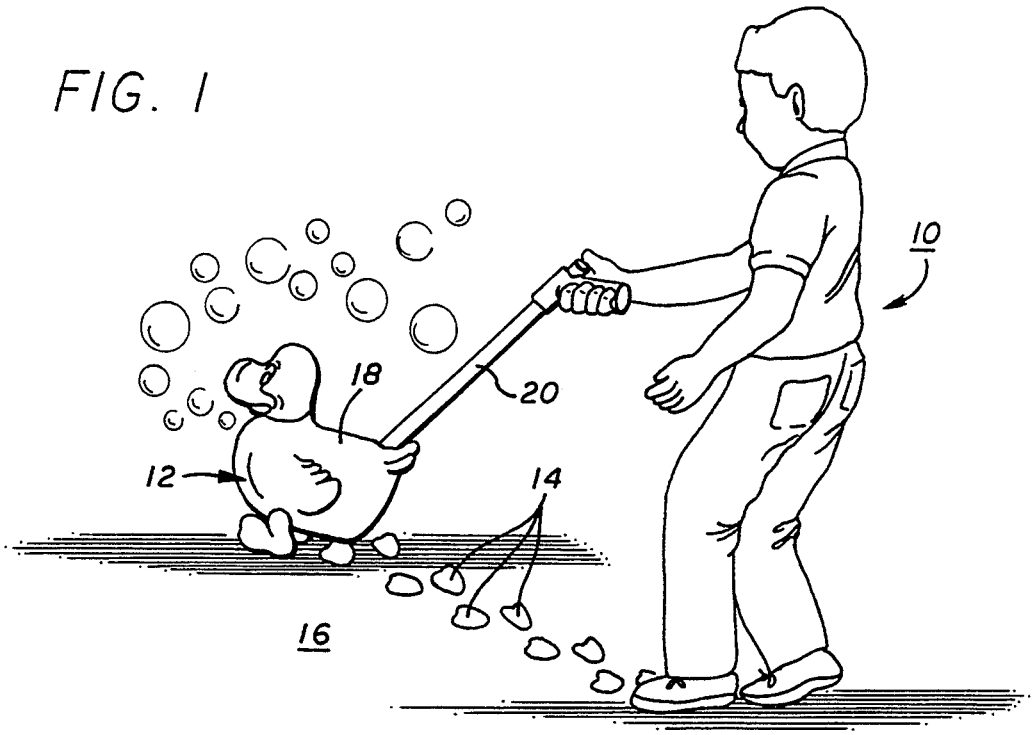
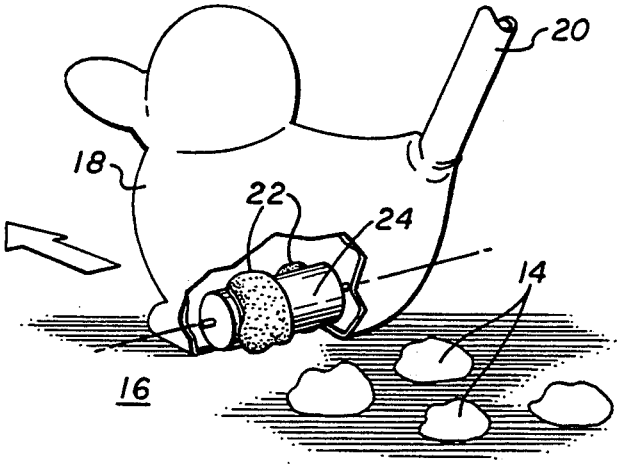
FIG. 2
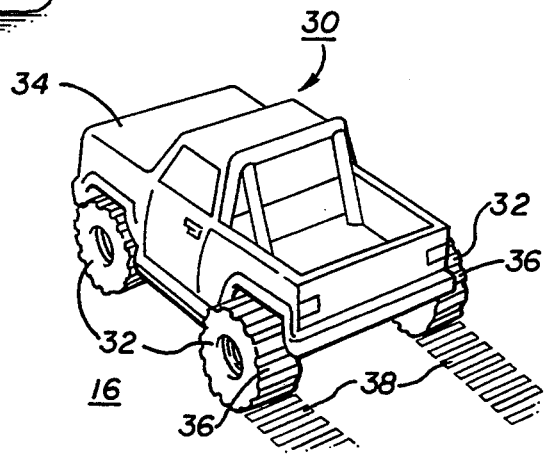
FIG. 3

FOOTPRINT GENERATING TOY

BACKGROUND OF THE INVENTION

1. Field of the Invention

The present invention relates to a toy device that can leave liquid footprints as the device is moved along a surface.

2. Description of Related Art

There has existed many toys that can be rolled or pushed across a surface. For example, there are toy vehicles that resemble a car or truck which have wheels that rotate and allow the user to move the vehicle along a floor. These vehicle type toys often incorporate lights or sounds that simulate a real car or truck. Playskool, Mattel Inc. and Tomy have marketed toy vehicles that incorporate figures which "pop" out of the device as the toy is pushed along a surface.

Tiger Electronics Inc., has marketed a series of toy devices under the trademark RUNAROUND PALS. The Tiger toys are constructed to resemble an animal that moves in a "life-like" fashion as the device is pushed along a surface. For example, the Tiger product line includes a rabbit-like toy marketed under the trademark HOPSY, which hops as the device is pushed along a sidewalk or other surface. Tiger Electronics also markets a toy under the trademark SCAMPS. SCAMPS is a dog shaped device that wiggles as the toy is moved by the user. The movement of SCAMPS resembles the movement of a real dog, so that a child can push the device and "pretend" that he is walking a dog.

There has also been marketed a movable toy by Playskool under the trademark BUBBLES THE PUP. BUBBLES THE PUP is a dog-like device which can be pulled along a surface and emit bubbles upon the depression of a switch. Playskool has also marketed a similar airplane toy that emits bubbles as the plane is moved through the air.

Fisher-Price has marketed a toy under the trademark BUBBLE LAWN MOWER. The Fisher-Price toy is constructed to resemble a lawn mower which emits bubbles as the device is pushed along a surface. Although all of the above described movable devices provide additional amusing features, none of the toys of the prior art leave a footprint on the moving surface. It would therefore be desirable to provide a toy that would leave a footprint or pattern as the device is moved on a surface.

SUMMARY OF THE INVENTION

The present invention is a toy device that leaves a liquid footprint as the device is moved along a surface. The device includes a housing that resembles a duck. Attached to the bottom of the duck is a roller that can rotate relative to the housing, so that the toy can be pushed or pulled along a sidewalk or other similar surface. The housing is connected to a handle that allows the user, such as a small child, to move the toy along the surface. Attached to the roller are a pair of sponge pads that are constructed to resemble the feet of a duck. The sponge pads are soaked with water and leave a liquid pattern when pressed into contact with a surface. The sponge pads are located on the roller so that a duck foot shaped pattern is left on the surface, each time the user moves the duck and rotates the roller.

The roller is operatively connected to a reservoir that continuously provides water to the sponge pads. The reservoir is of a sufficient capacity so that the user can move the duck and create a long series of liquid footprints. The reservoir may be replenished by rolling the duck through a water filled tray that is constructed to resemble a duck pond. The duck is also provided with a pair of legs that extend from the housing and are adapted to move in a lifelike fashion as the toy is pulled or pushed along the surface. The legs are in close proximity to the sponge pads so that it appears that the legs are leaving the footprints.

The toy device preferably has a bubble blowing system that produces bubbles when the user depresses a button located at the end of the handle. The handle may also have a sound emitting device that creates a quacking sound. The present invention therefore provides a duck-like toy that leaves duck prints, while quacking and blowing bubbles as the user moves the duck along a surface.

Therefore it is an object of the present invention to provide a toy that leaves a footprint as the toy moves along a surface.

It is also an object of the present invention to provide a duck-like toy that leaves duck prints as the device is moved along a surface.

BRIEF DESCRIPTION OF THE DRAWINGS

The objects and advantages of the present invention will become more readily apparent to those ordinarily skilled in the art after reviewing the following detailed description and accompanying drawings, wherein:

FIG. 1 is a perspective view showing a child pushing a toy of the present invention;

FIG. 2 is a perspective view of the toy of FIG. 1, showing sponge pads that can leave a liquid footprint when the toy is moved along a surface;

FIG. 3 is an alternate embodiment of the toy of FIG. 1, showing a vehicle that has four sponge tire members that leave tire tracks as the device is moved along a surface;

DETAILED DESCRIPTION OF THE INVENTION

Figure 4:
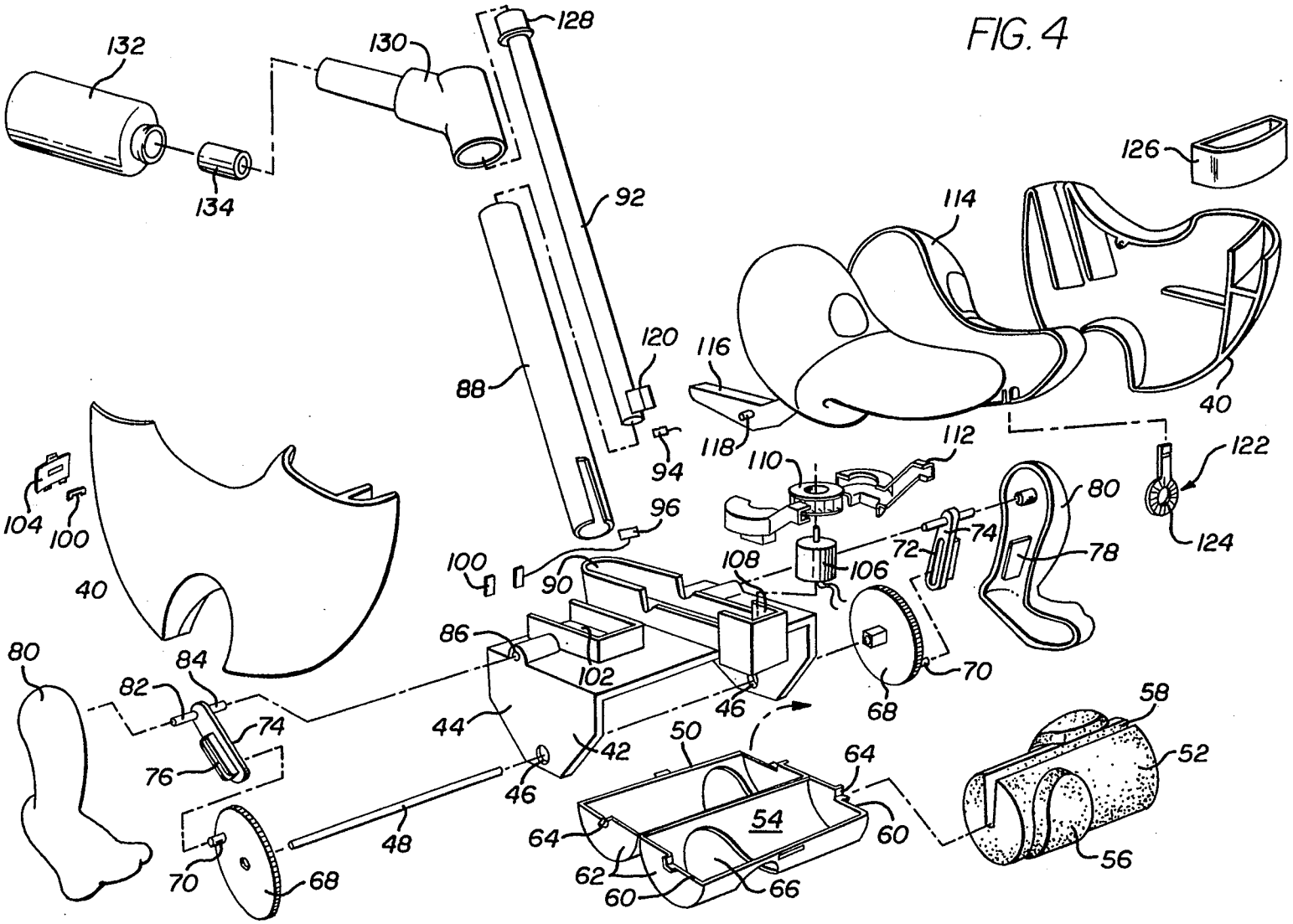
FIG. 4 is an exploded view of the toy of FIG. 1.

Referring to the drawings more particularly by reference numbers, FIG. 1 shows a child 10 moving a toy 12 of the present invention. The toy 12 leaves footprints 14 as the device 12 is moved along a surface 16. The toy 12 includes a housing 18 that is constructed to resemble a duck. Attached to the housing 18 is a handle 20 that allows the user 10 to move the toy 12 while the child is in an upright position. The handle 20 is typically constructed for children between the ages of 3–7 years old. The surface 16 is typically a sidewalk or another structure which can support the user and display the footprints 14.

FIG. 2 shows a pair of liquid absorbing members 22 which are attached to a roller 24. The roller 24 is connected to the housing 18 so that the roller 24 can rotate about a longitudinal axis when the user 10 moves the toy 10 along the surface 16. The liquid absorbing members 22 are typically constructed from sponge pads that are cut to resemble the feet of a duck. The sponge pads 22 are soaked with a fluid, so that there is a volume of fluid contained within the members 22. The fluid is typically water, although it is to be understood that any liquid can be employed.

The roller 24 is placed adjacent to the ground 16, so that the pads 22 can be pressed into contact with the surface 16. When the liquid absorbing members 22 are pressed into contact with the ground 16, the pads 22 are compressed and release water onto the surface 16, to create a liquid footprint 14 that corresponds to the shape of the members 22. The pads 22 are typically located on the roller 24 so that a footprint 14 is created every time the roller 24 rotates 180°. The pads 22 are also spaced apart so that the footprints 14 resemble the footprints 14 of a duck.

Although a duck shaped toy that leaves duck shaped prints is shown and described, it is to be understood that the toy may have any shape and may leave any liquid pattern. For example, FIG. 3 shows a toy 30 that is constructed to resemble a truck. The toy 30 has wheels 32 that are connected to a body 34, so that the wheels 32 will rotate when the toy 30 is moved along a surface 16. The wheels 32 are typically constructed from a sponge material that will absorb and retain a liquid. When the vehicle is rolled along the ground 16, the weight of the toy compresses the sponge material, which releases fluid onto the surface 16. Each wheel 32 typically has a plurality of ridges 36 that resemble the treads on a truck. When the toy is rolled along the surface 16, the wheels 32 release a plurality of liquid patterns that resemble truck tracks 38.

Figure 5:
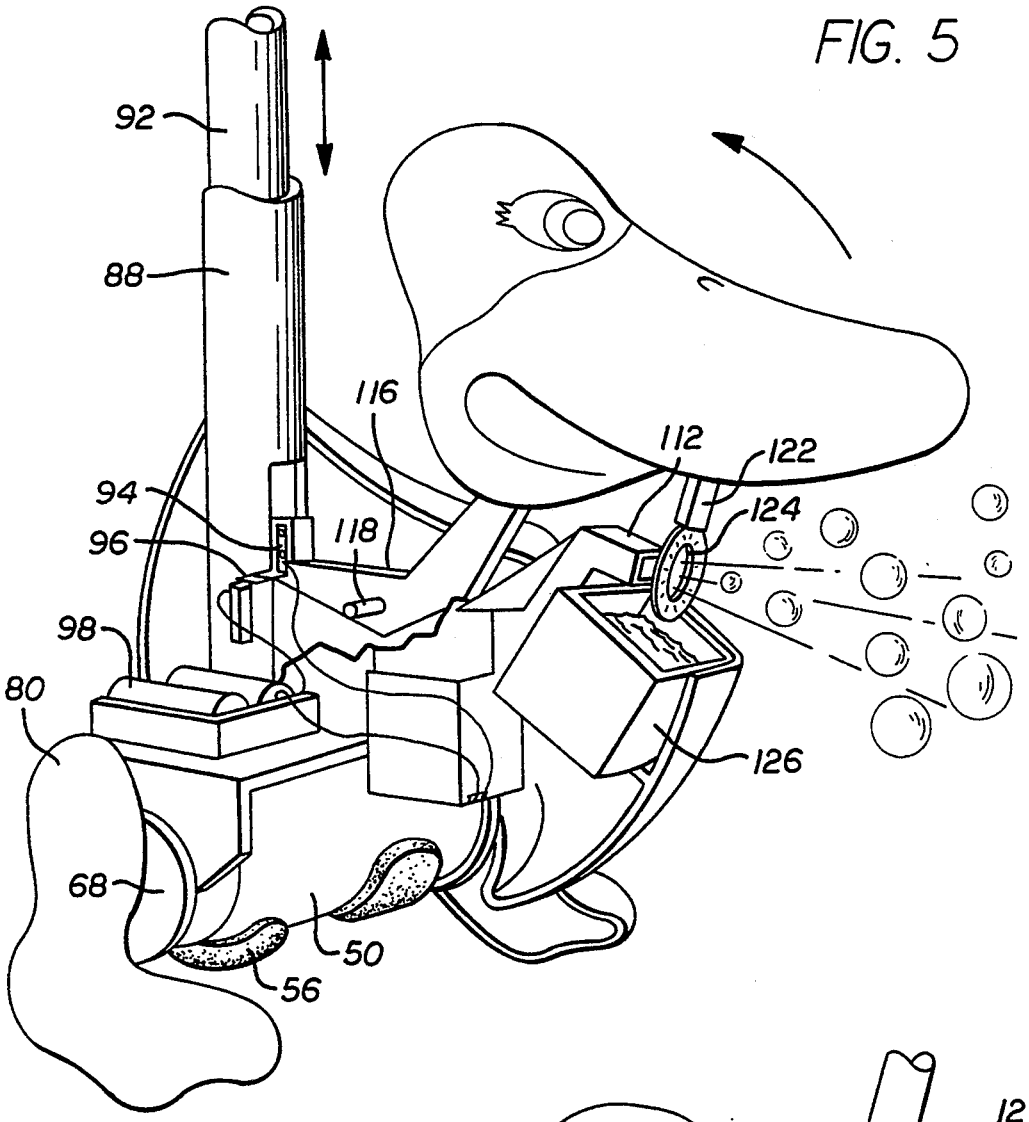
FIG. 5 is a cross-sectional view of the toy of FIG. 1.

FIGS. 4 and 5 show a preferred embodiment of the toy 12 of FIG. 1. The toy 12 includes a body shell 40 that encapsulates a chassis 42. The shell 40 is preferably constructed from two molded plastic pieces that resemble the body of a duck. The chassis 42 has a pair of walls 44 that each have an opening 46. Extending through the openings 46 is a shaft 48. The shaft 48 supports a roller 50 that is located between the walls 44.

The roller 50 is constructed to be unfolded so that a reservoir 52 can be placed into the inner cavity 54 of the roller 50. Attached to the reservoir 52 are a pair of liquid absorbing members 56 that are cut to resemble the feet of a duck. The reservoir 52 and members 56 are both typically constructed from sponge material that will absorb and retain a liquid. The reservoir 52 provides a continuous supply of fluid to the pads 56. The reservoir 52 and members 56 are typically filled by immersing the sponge filled roller 50 in water.

The roller 50 and reservoir 52 each have slots 58 that allow the shaft 48 to be inserted into the center of the two members. The slot of the roller 50 is formed by the stepped down portions 60 of the sidewalls 62 of the cylinder 50. The sidewalls 62 also have tabs 64 that are adapted to be inserted into the openings of the walls 44, so that the roller 50 can be attached to the chassis 42. The roller 50 is attached to the chassis 42, so that the roller 50 and members 56 can rotate about the shaft 48. The roller 50 has a pair of openings 66 that allow the pads 56 to extend through the cylinder. The roller 50 is located relative to the ground 16, so that the members 56 are compressed when rolled into contact with the surface 16.

The ends of the shaft 48 are connected to a pair of cam wheels 68. Each cam wheel 68 has a pin 70 that is inserted into a slot 72 in an actuating link 74. The actuating links 74 each have a groove 76 that receives a flange 78 which extends from a leg 80. The actuating links 74 also have outer pins 82 attached to the legs 80 and inner pins 84 inserted into holes 86 in the chassis 42. The pins 82 and 84 allow the actuating links 74 and legs 80 to rotate relative to the chassis 42.

When the toy 12 is moved along a surface 16, the roller 50 and shaft 48 are caused to rotate. Rotation of the shaft 48 rotates the cam wheels 68, which moves the pins 70 along the slots 72. Movement of the pins 70 pivots the actuating links 74 about the holes 84 of the chassis 42. The rotational movement of the links 74 also moves the legs 80 in a swinging motion. The legs 80 are constructed to resemble the legs of a duck, wherein the legs of the toy move in a walking like fashion when the user pushes or pulls the housing along the surface 16. The legs 80 are in close proximity to the members 56, so that it appears that the legs 80 are leaving the footprints when the toy 12 is moved along the surface. The legs 80 are also separated from the ground so that the leg members 80 do not come into contact with the surface 16. Such an arrangement insures that the pads 56 are always pressed onto the surface 16.

The toy 12 includes a hollow shaft 88 that is pressed into a slot 90 formed in the chassis 42. Extending through the hollow shaft 88 is an inner shaft 92 which can move between a first position and a second position. The shaft 92 is typically coupled to a spring (not shown) which biases the shaft 92 into the first position. Attached to the shaft 92 is a first metal contact 94 which is separated from a second metal contact 96 located on the hollow shaft 88. The second metal contact 96 is electrically connected to batteries 98, through battery contacts 100 located in a battery cavity 102 formed in the chassis 42. The toy 12 may have a door 104 to provide access to the batteries 98.

The first metal contact 94 is electrically connected to an electric motor 106 located in a motor cavity 108 formed in the chassis 42. The electric motor 106 is coupled to a fan 110 which is located within a duct 112. The metal contacts 94 and 96 function as a switch for the motor 106. When the inner shaft 92 is pushed into the second position, the first contact 94 comes into contact with the second contact 96. The coupling of the contacts provides power to the electric motor 106, which rotates the fan 110 and blows air through the duct 112.

The toy 12 has a head shell 114 which is preferably constructed from two molded plastic pieces that resemble a duck's head. Extending from the head 114 is a lever 116 which is pivotally connected to the chassis 42 by a pair of pins 118. The inner shaft 92 has a flange 120 which can engage and rotate the head 114 away from the body 40, when the shaft 92 is moved into the second position.

Extending from the head 114 is a ring 122 that has an aperture 124 which becomes aligned with the duct 112 when the head 114 is rotated away from the body 40. Attached to the body 40 is a trough 126 that typically contains a bubble making substance. When the shaft 92 is in the first position, the ring 122 is immersed in the bubble substance. When the shaft 92 is moved to the second position, the ring 122 is moved out of the trough 124, wherein there remains a volume of bubble substance in the aperture 124.

The inner shaft 92 has a button 128 which extends through an elbow 130 that is attached to the hollow shaft 88. The button 128 allows the user to push the shaft 92 into the second position, so that the bubble substance filled aperture 124 is aligned with the duct 112 and the metal contacts provide power to the electric motor 106. When the user pushes the shaft 92 into the second position, the fan 110 blows air through the aperture 124 to create bubbles that are emitted from the toy. The production of bubbles is terminated when the button 128 is released and the head 114 is allowed to rotate back to the original position.

A bellows 132 may be attached to the elbow joint 130. The bellows 132 is typically porous and contains a reed 134. The reed 134 produces a sound when the bellows 132 is compressed by the user. The reed 134 is preferably constructed to create a quacking sound to simulate the noise produced by a duck. The present invention therefor provides a toy that leaves footprints, quacks and makes bubbles as the device is pushed along a surface.

Figure 6:
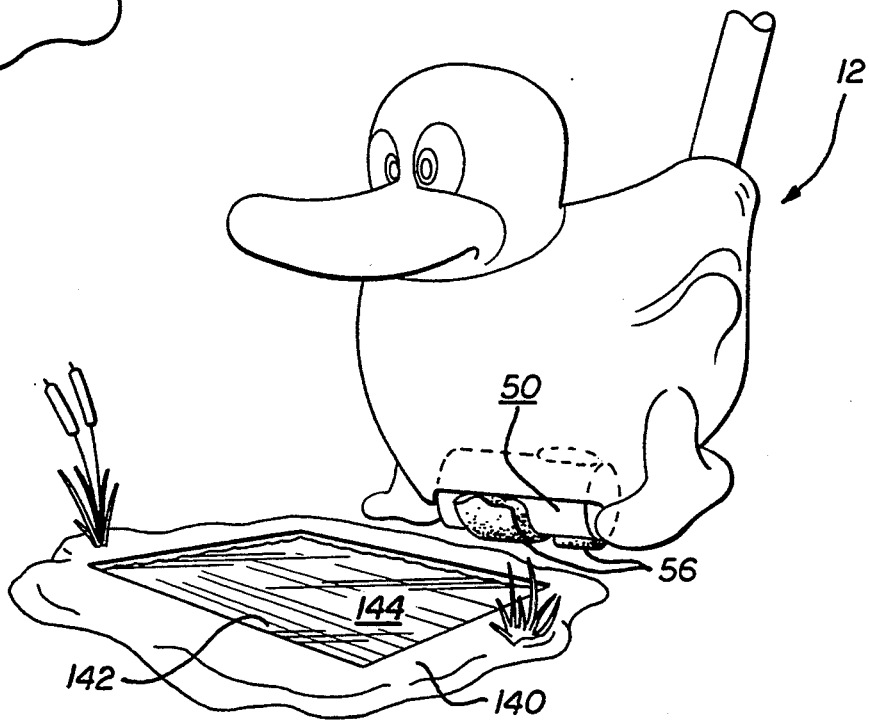
FIG. 6 is a perspective view of the toy of FIG. 1 being rolled into a water filled tray.

FIG. 6 shows a tray 140 which has a cavity 142 that is typically filled with water 144. The tray 140 allows the user to fill the reservoir 52 and pads 56 of the toy 12, by moving the roller 50 back and forth through the water filled cavity 142. The tray 140 is typically constructed to resemble a duck pond, wherein the duck leaves footprints after "wading" through the pond.

Figure 7:
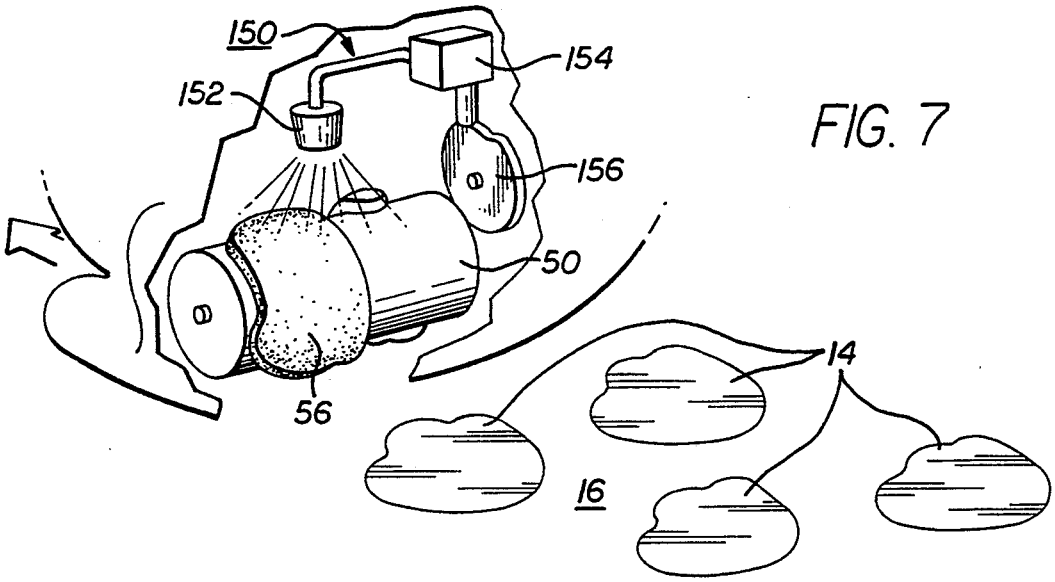
FIG. 7 is an alternate embodiment of the toy of FIG. 1, showing a spray system that periodically sprays water onto the sponge pads.

FIG. 7 shows an alternate embodiment wherein the toy has a spray system 150 that periodically sprays fluid onto the pads 56, to provide a continuous supply of fluid to the footprint forming members. The spray system 150 includes a nozzle 152 that is adjacent to the pads 56. The system 150 may have a separate nozzle for each pad 56, or one nozzle that can move along the roller 50 in synchronization with the pads 56. The nozzle 152 can be connected to a trigger operated pump 154 which is typically used in water guns. The roller 50 may be connected to a cam 156 that periodically depresses the trigger of the pump 154, which releases water onto a pad 56 as the toy is moved along a surface.

Figure 8:
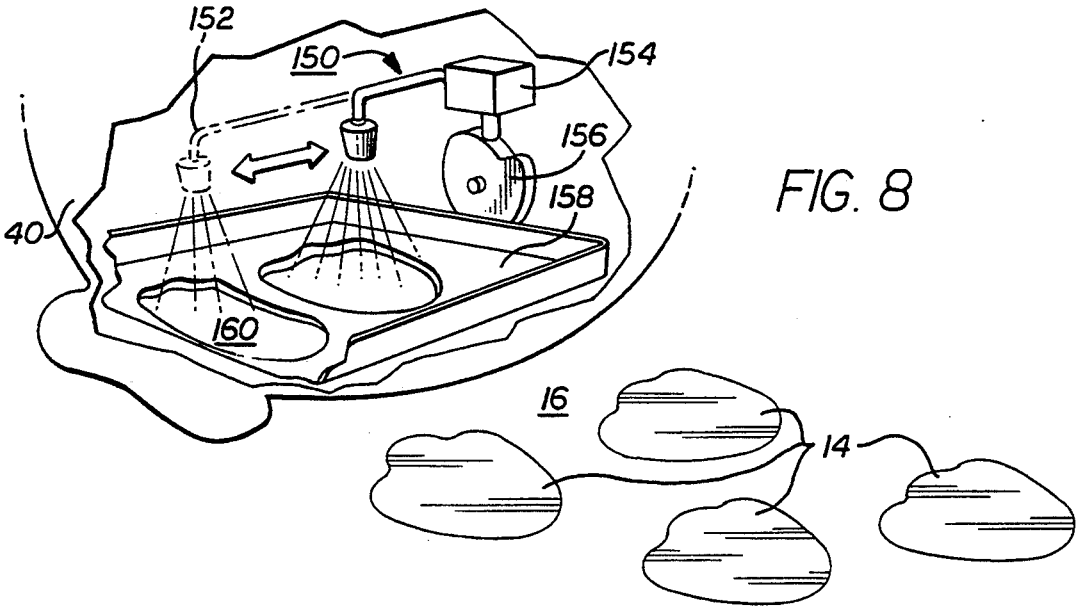
FIG. 8 is an alternate embodiment of the toy of FIG. 7, showing the spray system being used to spray a liquid footprint through a template attached to the housing of the toy.

FIG. 8 is an alternate embodiment of the toy wherein the spray system 150 sprays fluid onto the surface 16 through a template 158 attached to the body 40. The template 158 has a pair of openings 160 each shaped to resemble a duck's foot. When the duck is moved along the surface 16, the cam 156 rotates and periodically causes the pump 154 to spray water through one of the openings 160. The nozzle 152 is adapted to spray over the entire area of an opening 160. The toy may have either a nozzle for each opening 160, or a single nozzle that moves from opening to opening in accordance with the movement of the duck. The template 158 may have a drain connected to the pump 154, so that any fluid trapped by the template 158 flows back to the spray system 150.

Figure 9:
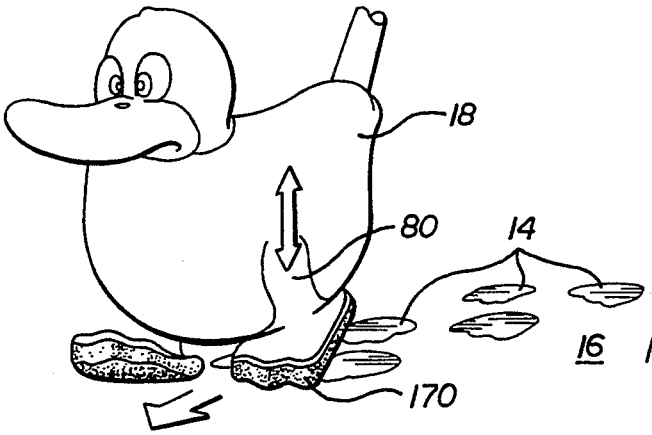
FIG. 9 is an alternate embodiment of the toy of FIG. 1, showing sponge pads attached to the bottom of a pair of feet that can move relative to a housing as the toy is moved along a surface.

FIG. 9 shows another alternate embodiment of the toy wherein foam pads 170 are attached to the bottom of the legs 80. The liquid absorbing members 170 are located relative to the housing 18, so that the legs 80 can compress the pads 170 and leave footprints on the surface 16. The legs 80 can be adapted to move using the cam wheel 68 and actuator link 74 assembly shown in FIGS. 4 and 5.

Although the toys shown and described in FIGS. 4-9 resemble a duck, it is to be understood that the above described devices can be constructed to resemble any other animal or object. For example, the toy may be constructed to resemble a dog, wherein the sponge pads 56 are constructed to leave the footprints of a dog.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A toy device that can be moved along a surface, comprising:

a housing adapted to be moved along the surface, said housing being constructed to simulate an animated character; and, a liquid absorbing member that is operatively connected to said housing such that said liquid absorbing member releases liquid onto the surface when said liquid absorbing material is in contact with the surface, in a manner that corresponds to footprints of said animated character;

a reservoir that is attached to said housing and supplies liquid to said liquid absorbing member.

2. The toy device as recited in claim 1, further comprising a roller that is attached to said liquid absorbing member and rotatably connected to said housing such that said liquid absorbing member is periodically placed into contact with the surface.

3. The toy device as recited in claim 2, further comprising a tray having a cavity that can be filled with liquid, said tray being constructed to allow said liquid absorbing member to be placed into said cavity such that said liquid absorbing member absorbs a volume of liquid.

4. The toy device as recited in claim 1, further comprising bubble producing means operatively connected to said housing for providing bubbles that are emitted from said housing.

5. The toy device as recited in claim 4, wherein said bubble producing means includes a ring that can be dipped into a reservoir of bubble substance attached to said housing, and a fan adapted to provide a stream of air through said ring to create said bubbles.

6. The toy device as recited in claim 1, further comprising sound producing means operatively connected to said housing for creating an audible sound.

7. A toy device that can be moved on a surface, comprising:

a housing adapted to be moved along the surface, said housing being constructed to simulate an animated character;

a handle connected to said housing;

a roller operatively connected to said housing so that said roller rotates about a longitudinal axis when said housing is moved along the surface;

a pair of liquid absorbing members attached to said roller so that said liquid absorbing members are in contact with the surface and leave a series of liquid patterns on the surface when said roller is rotated by the movement of said housing along the surface, wherein said liquid patterns correspond to footprints of said animated character: and, a reservoir that is attached to said housing and supplies liquid to said pair of liquid absorbing members.

8. The toy device as recited in claim 7, wherein said housing is constructed to resemble a duck.

9. The toy device as recited in claim 8, further comprising a pair of feet attached to said roller and extending from said housing, said feet being adapted to rotate relative to said housing when said housing is moved along the surface.

10. The toy device as recited in claim 7, further comprising a tray having a cavity that can be filled with liquid, said tray being constructed to allow said liquid absorbing members to be placed into said cavity such that said liquid absorbing members and said liquid absorbing reservoir absorb a volume of liquid.

11. The toy device as recited in claim 10, further comprising bubble producing means operatively connected to said housing for providing bubbles that are emitted from said housing.

12. The toy device as recited in claim 11, wherein said bubble producing means includes a ring that can be dipped into a reservoir of bubble substance attached to said housing, and a fan adapted to provide a stream of air through said ring to create said bubbles.

13. The toy device as recited in claim 12, further comprising sound producing means operatively connected to said housing for creating an audible quacking sound.

* * * * *